US010369458B2

(12) United States Patent
Stolten

(10) Patent No.: US 10,369,458 B2
(45) **Date of Patent: *Aug. 6, 2019**

(54) THREE-DIMENSIONAL PUZZLE OR DISPLAY PLATFORM

(71) Applicant: Mark Randall Stolten, Auckland (NZ)

(72) Inventor: Mark Randall Stolten, Auckland (NZ)

( * ) Notice: Subject to any disclaimer, the term of this patent is extended or adjusted under 35 U.S.C. 154(b) by 0 days.

This patent is subject to a terminal disclaimer.

(21) Appl. No.: 15/298,418

(22) Filed: Oct. 20, 2016

(65) Prior Publication Data

US 2017/0136345 A1 May 18, 2017

Related U.S. Application Data

(63) Continuation of application No. 14/123,312, filed as application No. PCT/IB2012/052788 on Jun. 3, 2012, now Pat. No. 9,586,132.

(30) Foreign Application Priority Data

Jun. 3, 2011 (NZ) ..... 593268

(51) Int. Cl.
*A63F 9/08* (2006.01)
*A63H 33/26* (2006.01)
*A63F 9/24* (2006.01)

(52) U.S. Cl.
CPC ..... *A63F 9/0857* (2013.01); *A63F 9/0811* (2013.01); *A63F 9/0842* (2013.01); *A63F 9/0861* (2013.01); *A63H 33/26* (2013.01); *A63F 2009/0815* (2013.01); *A63F 2009/2482* (2013.01)

(58) Field of Classification Search
CPC .... A63F 9/0826; A63F 9/0838; A63F 9/0865; A63F 9/0873; A63F 9/0842; A63F 9/0846; A63F 9/0857; A63F 9/0811; A63F 9/0861; A63F 2009/0815; A63F 2009/2482
See application file for complete search history.

(56) References Cited

U.S. PATENT DOCUMENTS 4,452,454 A * 6/1984 Greene ..... A63F 9/0857 273/153 S
4,522,401 A * 6/1985 Gustafson ..... A63F 9/0838 273/153 S
4,600,199 A * 7/1986 Krell ..... A63F 9/0842 273/153 S (Continued)

*Primary Examiner* — Steven B Wong
(74) *Attorney, Agent, or Firm* — W&C IP

(57) ABSTRACT

A three-dimensional platform comprising a tessellated surface of pieces, each piece comprising a top and sides. The pieces comprise a fixed square piece having at least two opposing sides orientated acutely relative to the top to define a fixed square retention surface. The remaining surfaces orientate substantially perpendicular relative to the top. There is a mobile square piece having at least two opposing sides orientated obtusely relative to the top to define a mobile square retention surface. The remaining surfaces are oriented substantially perpendicular relative to the top. A mobile triangular piece having all sides orientated obtusely relative to the top. The fixed square retention surface indexes only with either the mobile square retention surface or the triangular piece surface to effect retention of the pieces to define the three-dimensional platform.

19 Claims, 8 Drawing Sheets

(56) References Cited

U.S. PATENT DOCUMENTS 4,889,340 A * 12/1989 Greene ..... A63F 9/0857 273/153 S
5,074,562 A * 12/1991 Green ..... A63F 9/0857 273/153 S
5,114,148 A * 5/1992 Liu ..... A63F 9/0857 273/153 S
5,449,175 A * 9/1995 Nagy ..... A63F 9/0857 273/153 S
5,452,895 A * 9/1995 Ray ..... A63F 9/0857 273/153 S
5,566,941 A * 10/1996 Destics ..... A63F 9/0857 273/153 S
5,575,476 A * 11/1996 Yang ..... A63F 9/0842 273/153 S
5,816,571 A * 10/1998 Chen ..... A63F 9/0857 273/153 S
5,836,584 A * 11/1998 Chen ..... A63F 9/0857 273/153 S
5,992,850 A * 11/1999 Li ..... A63F 9/0826 273/153 S
6,857,632 B2 * 2/2005 Tanner ..... A63F 9/0857 273/153 S
7,547,019 B2 * 6/2009 Chen ..... A63F 9/0826 273/153 S
8,490,974 B2 * 7/2013 Stolten ..... A63F 9/0838 273/153 S
9,586,132 B2 * 3/2017 Stolten ..... A63F 9/0811
2006/0066049 A1 * 3/2006 Yahyavi ..... A63F 9/0861 273/153 S
2008/0061503 A1 * 3/2008 Giermek ..... A63F 9/0857 273/153 S
2009/0058001 A1 * 3/2009 Cantner ..... A63F 9/0838 273/153 S
2009/0096161 A1 * 4/2009 Fedoseyev ..... A63F 9/0861 273/153 S
2010/0264583 A1 * 10/2010 Hjerppe ..... A63F 9/083 273/153 S
2011/0272882 A1 * 11/2011 Yahyavi ..... A63F 9/0861 273/153 S

* cited by examiner

THREE-DIMENSIONAL PUZZLE OR DISPLAY PLATFORM

CROSS-REFERENCE TO RELATED APPLICATIONS

This application is a continuation application of U.S. Ser. No. 14/123,312 was a Rule 371 application of PCT/IB2012/052788.

FIELD OF THE INVENTION

The invention relates to puzzles or display platforms. More particularly the invention relates three-dimensional objects formed from multiple interlocking and substitutable puzzle pieces.

BACKGROUND

Three-dimensional puzzles typified by Rubik's cubes and sphere-like puzzles have been known in the art.

It is an object of the present invention to provide a new three-dimensional puzzle or display platform.

Accordingly it is an aspect of the present invention to provide an improved three-dimensional puzzle or display platform which will at least provide the public with a useful choice.

Other objects of the invention may become apparent from the following description which is given by way of example only.

BRIEF DESCRIPTION OF THE INVENTION

In one aspect the invention is a three-dimensional puzzle or display platform that comprises a central core and a tessellated surface of pieces arrayed around the core, each piece comprising a top and sides, and the pieces comprising a plurality of moveable pieces that move around the core in one or two axis of direction, a plurality of types of fixed pieces, each type of fixed piece having a specific surface geometry, and wherein the central core and plurality of types of fixed pieces comprise an anchoring mechanism that allows substitution of a fixed piece type with another fixed piece type, and wherein the selection of the fixed piece type defines the movement available to the moveable pieces such that selection of a type of fixed piece allows the moveable piece to move in two axis of rotation, and selection of an alternate fixed piece allows the moveable piece to move in two axis of rotation.

In one aspect the invention is a three-dimensional puzzle or display platform comprising a centroid and a tessellated surface of pieces about the centroid, each piece comprising a top and sides, and the pieces comprising a plurality of types of fixed pieces selected from (i) square form pieces, (ii) triangular form pieces, (iii) integrated square form and triangular form pieces, and (iv) one or more of (i) to (iii), and a plurality of moveable pieces selected from (a) square form pieces, (b) triangular form pieces, (c) rectangular form pieces, and (d) one or more of (a) to (c), and wherein the tessellated surface of pieces about the centroid is formed from a combination of fixed and moveable pieces with the proviso that if the fixed piece is a square form piece then the moveable pieces are selected from any one of (a) to (d), if the fixed piece is a triangular form piece then the moveable pieces are selected from (a) and/or (c), if the fixed piece is an integrated square form and triangular form piece then the moveable pieces are selected from (a) and/or (c), and wherein the fixed pieces are fixed to the centroid by an anchoring mechanism that allows substitution of fixed pieces by each other.

In one aspect the invention is a three-dimensional puzzle or display platform comprising a tessellated surface of pieces, each piece comprising a top and sides, and the pieces comprising a fixed square piece having at least two opposing sides orientated acutely relative to the top to define a fixed square retention surface, and the remaining surfaces oriented substantially perpendicular relative the top, a mobile square piece having at least two opposing sides orientated obtusely relative to the top to define a mobile square retention surface, and the remaining surfaces oriented substantially perpendicular relative the top, a mobile triangular piece having all sides orientated obtusely relative to the top, wherein the fixed square retention surface indexes only with either the mobile square retention surface or the triangular piece surface to effect retention of the pieces to define a three-dimensional platform.

In a further aspect the invention is a three-dimensional puzzle or display platform comprising a tessellated surface of pieces positioned about a centroid, a first set of pieces fixed to, and interspersed about, the centroid to define at least one at least partially circumferential pathway through which a second set of pieces are mobile, the first set of pieces defining a retention surface, the second set of pieces comprising at least two forms, an optional first form having at least two sides orientated obtusely relative to the top to define a retention surface, and the remaining surfaces oriented substantially perpendicular relative the top, an optional second form having at least two sides orientated acutely relative to the top to define a retention surface, and the remaining surfaces oriented substantially perpendicular relative the top, and an optional third form having at least three sides orientated obtusely relative to the top to define a retention surface, wherein the optional first, second or third forms are either square or triangular in form.

In a further aspect the invention is a three-dimensional puzzle or display platform comprising a tessellated surface of pieces, each piece comprising a top and sides, and the pieces comprising a plurality of triangular pieces and a plurality of mobile square form pieces, the triangular pieces held to the centroid surface by an anchoring mechanism, the fixed triangular pieces having sides defining a retention mechanism, the retention mechanism including at least a portion of each side surface extending over a portion the square form pieces, wherein the retention surface of the triangular pieces defines a three-dimensional platform.

In a further aspect the invention is a three-dimensional puzzle or display platform comprising a tessellated surface of pieces, each piece comprising a top and sides, and the pieces comprising centroid having on a surface a plurality of triangular pieces and a plurality of mobile square form pieces to substantially cover the surface, the triangular pieces held to the centroid surface by an anchoring mechanism, the triangular pieces having sides defining a retention mechanism, the retention mechanism including at least a portion of each side surface extending over a portion the square form pieces, and, defining a plurality of channels that extends across the centroid surface through the surface area not occupied by the triangular pieces, the plurality of mobile square pieces comprising at least two kinds, a first kind having parallel opposing sides, and a second kind having two parallel opposing sides and the remaining two opposing sides having a surface that is at least somewhat obtuse in angle with reference to a top surface, the angled sides providing selective mobility of the second kind of piece through each channel.

In a further aspect the invention is a three-dimensional puzzle or display platform consisting in or comprising:

a centroid defining a substantially spherical surface, a first plurality of first form pieces having a retention mechanism and attached to the surface by an anchoring mechanism, a second plurality of second form pieces on the surface, wherein the second form pieces are retained on the centroid surface by a combination of the centroid surface and the retention mechanism of the first form pieces.

In a further aspect the invention is a three-dimensional puzzle or display platform comprising a tessellated surface of pieces, each piece comprising a top and sides, and the pieces comprising centroid having on a surface a plurality of triangular pieces and a plurality of mobile square form pieces to substantially cover the surface, a selection of the square pieces held to the centroid surface by an anchoring mechanism, the selection of the square pieces anchored to the surface having sides defining a retention mechanism, the retention mechanism including at least a portion of each side surface extending over the other pieces, and, defining a plurality of channels that extends across the centroid surface through the surface area not occupied by those pieces that are anchored, the plurality of mobile square pieces and mobile triangular pieces The following embodiments may relate to any of the above aspects.

In some embodiments the anchoring mechanism allows rotation of each fixed piece about its axis.

In some embodiments the fixed pieces are readily substituted by one another.

In some embodiments the fixed pieces are easily substituted by one another in the course of use of the three-dimensional puzzle or display platform.

In some embodiments the moveable pieces have at least two opposing sides orientated obtusely relative to the top to define a mobile square retention surface, and the remaining surfaces oriented substantially perpendicular relative the top, the fixed pieces have at least two opposing sides orientated acutely relative to the top to define a fixed square retention surface, and the remaining surfaces oriented substantially perpendicular relative the top, and the triangular pieces each have all sides orientated obtusely relative to the top.

In some embodiments the first plurality of segments are layered on the surface such that the surface is at least partially enclosed.

In some embodiments the first and second plurality of segments substantially enclose the surface of the centroid.

In some embodiments the first and second plurality of segments form a substantially tessellated surface above the surface of the centroid.

In some embodiments the first plurality of segments define at least one pathway or channel.

In some embodiments the at least one pathway extends around the surface of the centroid.

In some embodiments the at least one pathway defines one or more rotational planes.

In some embodiments the at least one pathway define a plurality of rotation planes.

In some embodiments the plurality rotational planes are evenly interspersed about the surface of the centroid.

In some embodiments the second plurality of segments are moveable within, or at least guided by, the at least one pathway.

In some embodiments the first plurality of segments are rotatable on the surface of the centroid about the anchor.

In some embodiments the first plurality of segments comprise a contour on at least one edge surface, the contour shaped, such that when abutted with the one or more of the second plurality of segments, the second plurality of segments are prevented from being lifted from the surface of the centroid.

In some embodiments the contour on at least one edge surface of the first plurality of segments comprises a lip or overhang.

In some embodiments the lip or overhang extends, at least partially, above a portion of one or more of the second plurality of segments.

In some embodiments the second plurality of segments are retained by the lip or overhang and the surface of the centroid.

In some embodiments the contour on at least one edge surface of the first plurality of segments comprises at least one edge of the first plurality of segments having a tapered side profile.

In some embodiments at least one edge of at least one of the second plurality of segments has a tapered side profile complimentary to the tapered side profile of the first plurality of segments.

In some embodiments at least some of the second plurality of segments, on at least one edge portion, define an edge profile such that when abutted with another of the second plurality of segments, the second plurality of segments are prevented from being lifted from the surface of the centroid.

In some embodiments either the first plurality of segments or the second plurality of segments, or both, has a combination of contoured side edges and parallel side edges.

Other aspects of the invention may become apparent from the following description which is given by way of example only and with reference to the accompanying drawings.

As used herein a definition defined in a plural or singular form holds good for the opposite. i.e. the singular or plural form.

It is intended that reference to a range of numbers disclosed herein (for example, 1 to 10) also incorporates reference to all rational numbers within that range (for example, 1, 1.1, 2, 3, 3.9, 4, 5, 6, 6.5, 7, 8, 9 and 10) and also any range of rational numbers within that range (for example, 2 to 8, 1.5 to 5.5 and 3.1 to 4.7).

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

The invention will now be described by way of example only and with reference to the drawings in which:

DETAILED DESCRIPTION OF THE INVENTION

Figure 1:
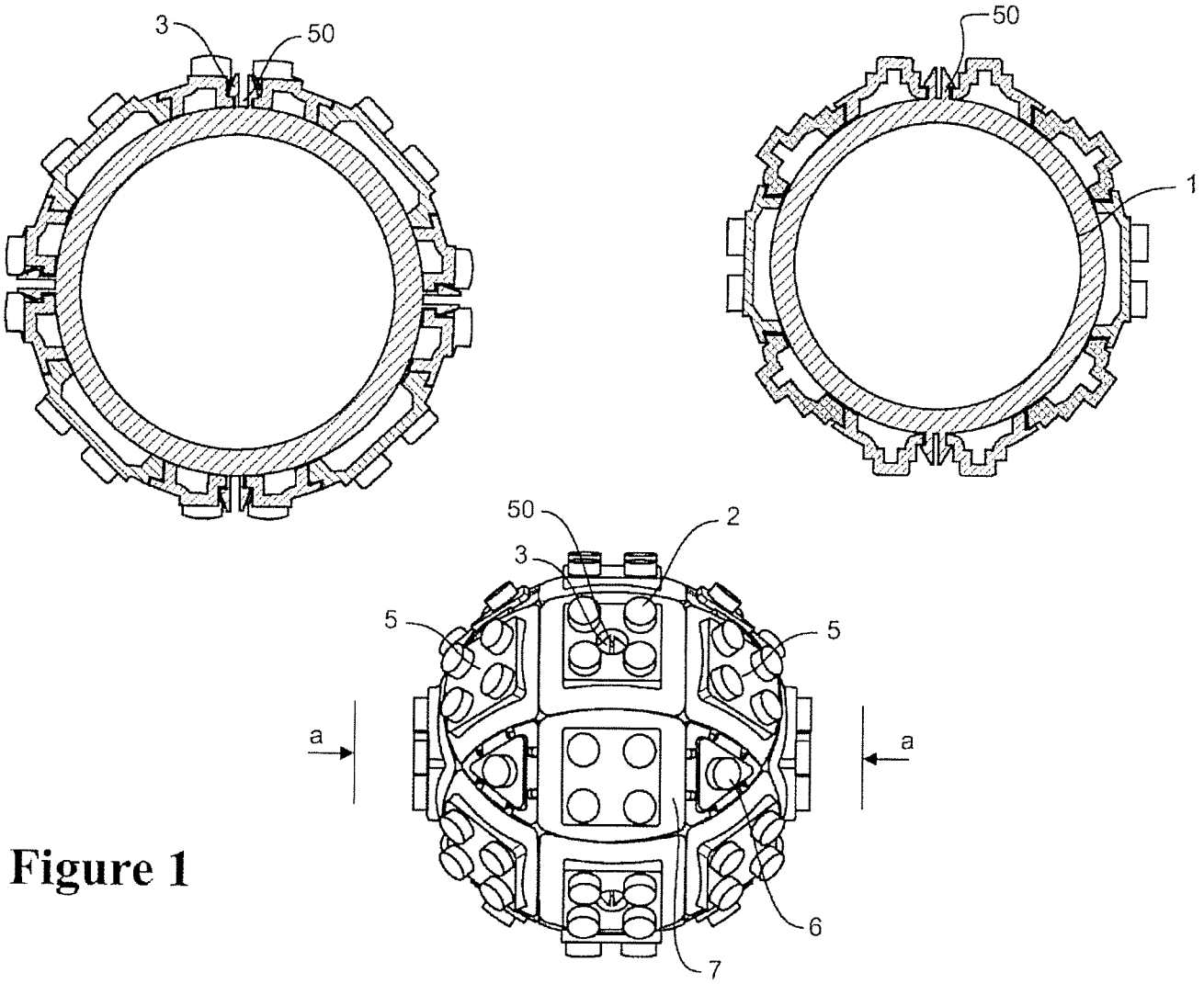
FIG. 1 shows a three-dimensional platform, amusement device or display apparatus according to preferred embodiments of the invention.

The present invention relates to a three-dimensional puzzle or display platform that comprises a central core and a tessellated surface of pieces arrayed around the core, each piece comprising a top and sides, and the pieces comprising a plurality of moveable pieces that move around the core in one or two axis of direction, a plurality of types of fixed pieces, each type of fixed piece having a specific surface geometry, and wherein the central core and plurality of types of fixed pieces comprise an anchoring mechanism that allows substitution of a fixed piece type with another fixed piece type, and wherein the selection of the fixed piece type defines the movement available to the moveable pieces such that selection of a type of fixed piece allows the moveable piece to move in two axis of rotation, and selection of an alternate fixed piece allows the moveable piece to move in two axis of rotation.

The present invention also relates to a three-dimensional puzzle or display platform that comprises a central core and a tessellated surface of pieces arrayed around the core, each piece comprising a top and sides, and the pieces comprising a plurality of moveable pieces, having at least two opposing sides orientated obtusely relative to the top to define a mobile square retention surface, and the remaining surfaces oriented substantially perpendicular relative the top, a plurality of types of fixed pieces, each fixed piece having at least two opposing sides orientated acutely relative to the top to define a fixed square retention surface, and the remaining surfaces oriented substantially perpendicular relative the top, and a mobile triangular piece having all sides orientated obtusely relative to the top, and wherein the central core and plurality of types of fixed pieces comprise an anchoring mechanism that allows substitution of a fixed piece type with another fixed piece type.

1. Definitions

As used herein the term "axis of direction" means in the direction of one of the Cartesian axis.

As used herein "Cartesian axis" refers to three axis of freedom of movement, each at 90° to each other.

As used herein the term "core" is used interchangeably with the term "centroid".

As used herein the term "readily substituted" means that the fixed pieces can be removed from the surface of the device and replaced with another fixed piece in the normal course of use of the three-dimensional puzzle or display platform.

As used herein "equatorial" refers to any ring around said centroid whose axis passes through the centre of said centroid.

As used herein "general sphere" refers to an object of a spherical shape notwithstanding any indentations, projections, contours or surface configurations.

As used herein "square form" refers to a puzzle piece having, when considered substantially normal to the general surface of a spherical puzzle, a substantially square form in respect of the positioning of the corners of the piece despite any minor indentations, markings or depression in the line of its periphery.

As used herein reference to a "substantially square form" "square form" is used interchangeably with "first playing piece".

As used herein reference to a "substantially triangular form" or "triangular form" is used interchangeably with "second playing piece".

As used herein "tessellated", substantially tessellated", etc is of more than a single shape repeating in the resultant surface.

As used herein "triangular form" refers to a puzzle piece having, when considered substantially normal to the general surface of a spherical puzzle, a substantially triangular form in respect of the positioning of the corners of the piece despite any minor indentations, markings or depression in the line of its periphery.

As used herein the term "and/or" means "and" or "or".

As used herein the term "s" following a noun means the plural or singular form of that noun as might be appropriate and not necessarily dependent on the syntax in which it is present as to which is meant.

2. Centroid

Shown in FIG. 1 in cross-section is a centroid 1. The pieces are layered upon the surface of the centroid.

In some embodiments the centroid is hollow or solid, or alternatively be skeletal or lattice-like in form.

The centroid includes an anchoring mechanism that corresponds tot the attachment mechanism of the fixed pieces.

In one embodiment the anchoring mechanism is a complementary friction-fit insert for a receiver, wherein the fixed piece carries a projection, as the friction-fit insert, and the centroid comprises one or more receivers for insertion of the projection.

It should be appreciated that other anchoring mechanism could be used within the invention, provided that they allow substitution of different types of fixed pieces with each other and rotation of each fixed piece relative to the axis of the anchor and/or the surface of the centroid.

In some embodiments the centroid carries one or more projections, as a friction-fit insert for a fixed piece that carries a complementary receiver.

In some embodiments the centroid carries both one or more projections, as a friction-fit insert for a fixed piece that carries a complementary receiver, and one or more receivers, to receive a fixed piece that carries a projection, as a friction-fit insert for the receiver carried by the centroid.

When the centroid is in a hollow form it should be appreciated that any number of objects could be encased within the periphery of said centroid such as a glow ball or the like.

3. Pieces

The present invention comprises a number of different pieces that, when combined together, form the tessellated surface of the three-dimensional puzzle or display platform.

The present invention allows for substitution of the various types of fixed pieces wherein the choice of fixed type piece anchored to the centroid defines the rotational movement available to the moveable pieces.

In some embodiments the pieces are selection from the group comprising fixed square form pieces, fixed triangular form pieces, moveable square form pieces, moveable triangular form pieces, and integrated pieces (formed as a combination of two notionally triangular form pieces and one notionally square form pieces).

In some embodiments

- the moveable pieces have at least two opposing sides orientated obtusely relative to the top to define a mobile square retention surface, and the remaining surfaces oriented substantially perpendicular relative the top,
- the fixed pieces have at least two opposing sides orientated acutely relative to the top to define a fixed square retention surface, and the remaining surfaces oriented substantially perpendicular relative the top, and
- the triangular pieces each have all sides orientated obtusely relative to the top.

As shown in FIG. 1, in some embodiments the moveable pieces include both square form pieces and triangular pieces that move around the centroid 1 in one or two axis of direction, such as when the fixed piece has a square form shape.

Figure 2:
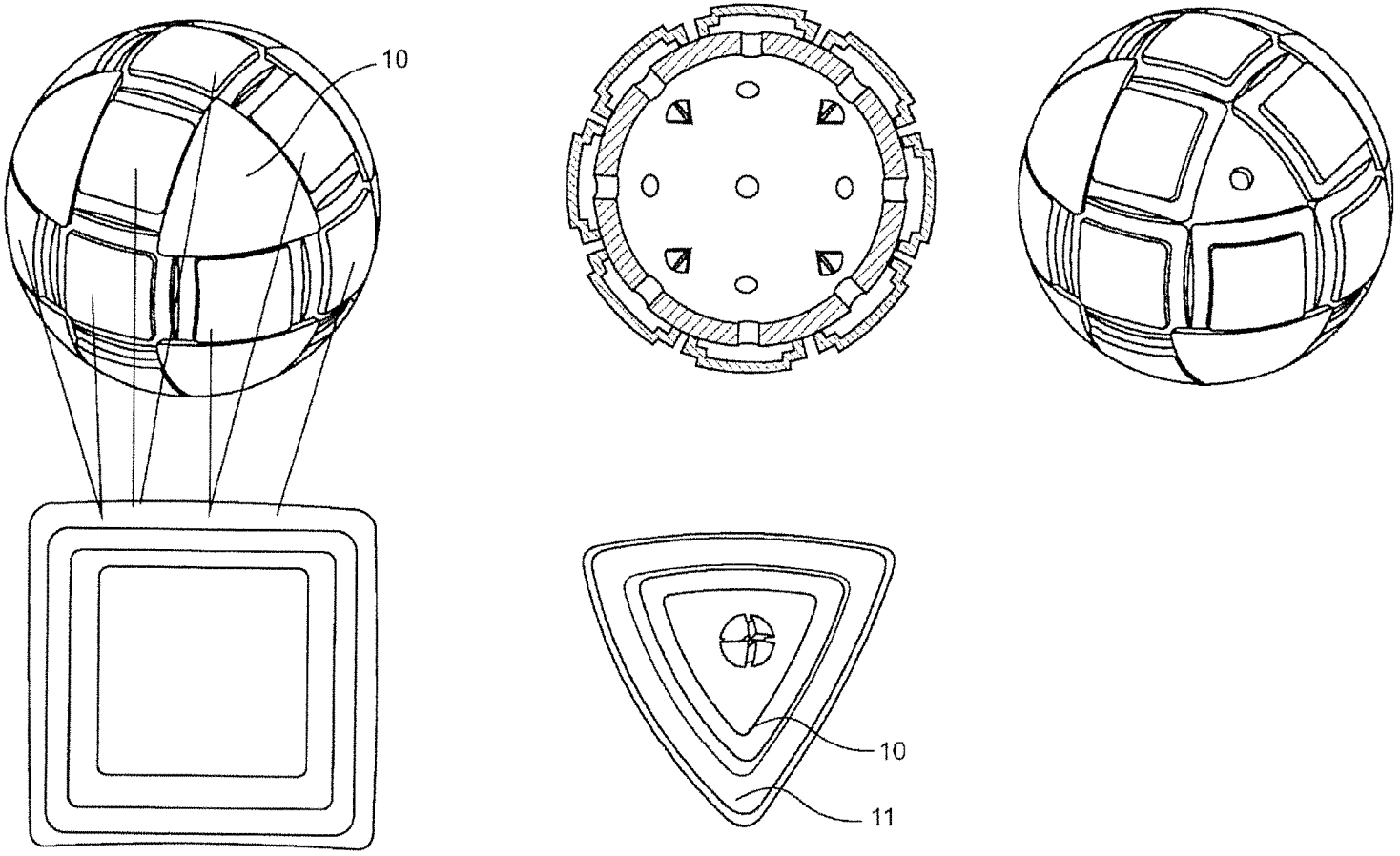
FIG. 2 shows a variation of the embodiment of FIG. 1.

As shown in FIG. 2, in some embodiments the moveable pieces are all square form pieces, such as when the fixed piece is of a triangular shape.

In some embodiments the square form and triangular form pieces have sides of substantially equal chord length.

In some embodiments any of the pieces may optionally include an attachment mechanism, such as nodule and/or recesses used by LEGO building blocks, so that further layers of pieces may be arranged on or engaged with the surface.

A first kind 2 of piece is preferably substantially square in form, yet may also be substantially triangular in form, and includes an anchoring mechanism 3. The piece 2 may be bulbous in contour such that it conforms to the surface contour of the centroid.

A second kind of piece 5 is shown adjacent to the first kind of piece 2. Preferably the second kind is substantially square in form, but alternatively may be substantially triangular in form. Similarly, the second kind of piece may be bulbous in profile such that it may conform to the centroid surface to which it may be adjacent.

A third kind of piece 6 is shown adjacent to the first and second kind of pieces. Preferably the third kind of piece is substantially triangular in form, but may alternatively be substantially square in form.

Preferably the length of indexing sides of each of the substantially square and substantially triangular form pieces is substantially similar to that of the piece they index to. More preferably the chord lengths of each of the indexing sides of each playing piece are substantially similar. As used herein "chord length" is the length of the sides of the pieces when taken from corner to corner.

To further facilitate alignment and movement of the various pieces, it is preferable that each of the pieces, whether substantially triangular or substantially square, when viewed radially from the centroid, have chords of substantially equal length. That is, pieces substantially square in form have four substantially equal length sides and pieces substantially triangular in form have three substantially equal length sides. However, the substantially triangular or square forms of the kinds of pieces may optionally have bulbous sides where it may be advantageous to do so, such as to provide gap free fitment between adjacent pieces.

FIG. 1 shows a piece 7 according to the second kind of pieces that has a substantially square form, yet has two opposing sides that are parallel, and two opposing sides that are bulbous in form. Other pieces attached to the centroid may share this side form where it would promote close fitment between pieces.

The pieces form a spherical surface with a diameter greater than that of the centroid. In order to achieve this, each piece optionally comprises a spacing element which projects the upper surface area from the surface of the centroid.

It should be appreciated that the relative size of the centroid to the total piece size can be varied. That is, it should be appreciated that the height of the pieces could range greatly relative to the size of the centroid. It should also be appreciated that as the height of a piece decreases relative to its width, the distance of any magnet to the edge of the piece can be increased therefore decreasing the magnetic interaction with other adjacent pieces.

4. Piece Retention

Preferably there is a mechanism between the three kinds of piece that retains or at least provides the effect of retaining each of the pieces to, or on the centroid surface. The retention is preferably provided by a retention surface, or lip, that extends, overhangs, or cantilevers from the first kind of piece 2. In this way, when the first kind of piece has an edge surface abutted by either the second, or the third, or both kinds of pieces, the retention surface acts to substantially prevent the second and/or third pieces from being lifted from the surface of the centroid.

The retention mechanism is most preferably formed by appendages, adaptations, shaping or mouldings on the first kind of piece. The second or third kinds of pieces may optionally have formed, at or near an edge surface, a complimentary contour that aids or compliments the retention mechanism. For example, the retention mechanism may be an acutely angled side surface that engages with an obtusely angled side surface to thereby define an overlapping potion of the pieces that prevents the second and/or third kinds of piece from being lifted. The second and/or third kinds of pieces may also have a recess or sunken portion that allows an extending or overhanging portion of the first kind of piece to be indexed or at least partially received.

It follows that assembly of the pieces to the centroid should begin with layering the desired first and/or second pieces and lastly layering the first kind of pieces such that the retention mechanism overlays the already assembled pieces.

In FIG. 1, the retention mechanism is shown as an overhang that extends from an edge portion of the first kind of piece, and at least partway over the upper edges of the second and third kinds of piece. The retention mechanism ensures the second and third kinds of pieces are held between the centroid surface and the first kind of pieces. The retention mechanism advantageously enables a method of construction whereby the second and third kinds of pieces can be arranged about the centroid in a preferred order, yet retained by the addition of the first kind of piece and the anchoring mechanism.

Preferably the retention mechanism also defines a series of channels, or pathways, that extend around the surface of the centroid relative to the first kind or piece which are fixed, or rotatably fixed, in position. The pathways allow the second and third kinds of pieces to be rotated or positionally arranged relative to the first kind of piece that remains substantially fixed in position. In this way, a series of moveable bands, or groups of pieces, are formed. Each band is rotatable about the centroid surface through any of the defined pathways when such pieces that comprise the band are positionally aligned about those pieces that are fixed. Further, as the anchoring mechanism preferably allows the first kinds of piece to rotate relative to the centroid surface, a group of pieces, forming a cap, can co-act to allow up to six defined poles to rotate.

5. Anchoring Mechanism

The anchoring mechanism fastens some or all of the pieces to the surface of the centroid. Preferably the anchoring mechanism is provided by a friction fit between one or more anchoring protrusions 50 that extend from the outer surface of the centroid and an aperture 3 in the piece 2 to engage with the protrusion.

Alternatively, the anchoring mechanism may be of other forms, such as Velcro or glue, or a combination of a nodule and a recess. However, it is preferable that the anchoring mechanism allows the piece to which it anchors to rotate, or spin, relative to the axis of the anchor and/or the surface of the centroid.

FIG. 2 shows another embodiment where the centroid has anchored to it by the anchoring mechanism a plurality of substantially triangular pieces 10 according to a first kind of piece. The outer edges of the substantially triangular piece 10 extend outward on an upper portion of the edge surface to define a retention mechanism 11. When pieces 10 are anchored to the centroid, subsequent substantially square form pieces according to a second and/or third kind of piece are retained beneath the retention mechanism and thereby held upon the surface of the centroid.

6. Three-dimensional Puzzle or Display Platform

A number of rotational bands are formed about the surface of the centroid as defined by the side surfaces of those pieces 10 fixed to the centroid. The bands comprise an arrangement of second and/or third kinds of pieces. The pieces in the band can be rotated, or slid, about the centroid surface, as provided they are aligned with the channels formed by the retention mechanism, as desired.

In this particular embodiment the substantially square form pieces are arranged in three equatorial bands, comprising square form pieces each, along each of the three Cartesian axis. Therefore, each band can rotate around the centroid at 45 degrees relative to each other. Those squares that are placed at the intersection between two Cartesian bands (e.g. x-axis and y-axis) are therefore able to be rotated in either direction of each of the two Cartesian axis (e.g. horizontal or vertical). Each square may be rotated in a direction so that each square indexes to a position held by a previous square. For example, if the square pieces are rotated around said centroid by one position, then they fill a position which was previously filled by an adjacent square piece. Pieces may be rotated any number of positions.

Figure 3:
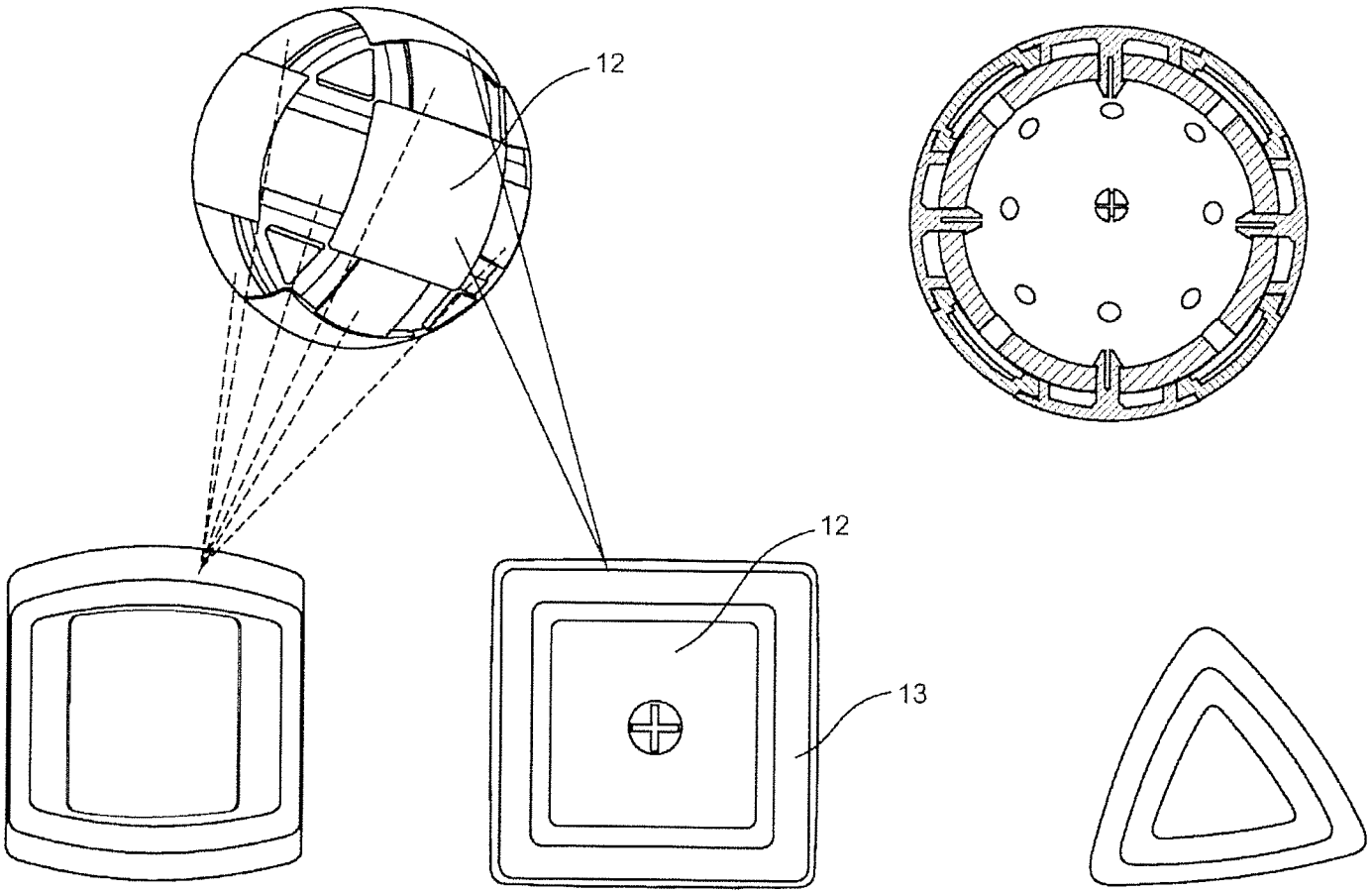
FIG. 3 shows a variation of the embodiments of FIGS. 1 and 2.

FIG. 3 shows another embodiment where a plurality of substantially square form pieces 12 are anchored to the centroid. Each of the anchored square form pieces 12 have a lip or overhang 13 protruding from the upper portions of each side surface to define a retention mechanism.

Square form pieces according to a second kind of piece and triangular form pieces according to a third kind of piece are arranged in the channels defines by the retention mechanism. Preferably the square form pieces have two opposing sides parallel in form, and two opposing sides bulbous in form. The bulbous side formation ensure gap free fitment to adjacent pieces when conforming to the surface curvature of the centroid.

Preferably the triangular form pieces have a profile that allows the retention mechanism to extend at least partially over the top surface.

Side edges of the second and third kind of pieces may optionally have an edge profile contoured or tapered when viewed tangentially to the side surfaces. The optionally tapered edges allow gap free abutment of adjacently placed pieces when layered to the centroid surface.

The fixed pieces 12 form a series of channels or pathway or rotational bands that extend circumferentially about the centroid surface through which the second and third kinds of pieces are mobile. In this embodiment, six rotational groups of segments are formed when the first second and third kinds of pieces are layered to the centroid surface. The rotational groups comprise one of each of the fixed pieces 12 and the square and triangular pieces that are abutted about each side surface. In this way, each group forms a cap that can be selectively rotated. Each group or cap is rotated 90 degrees before another cap can be rotated.

Figure 4:
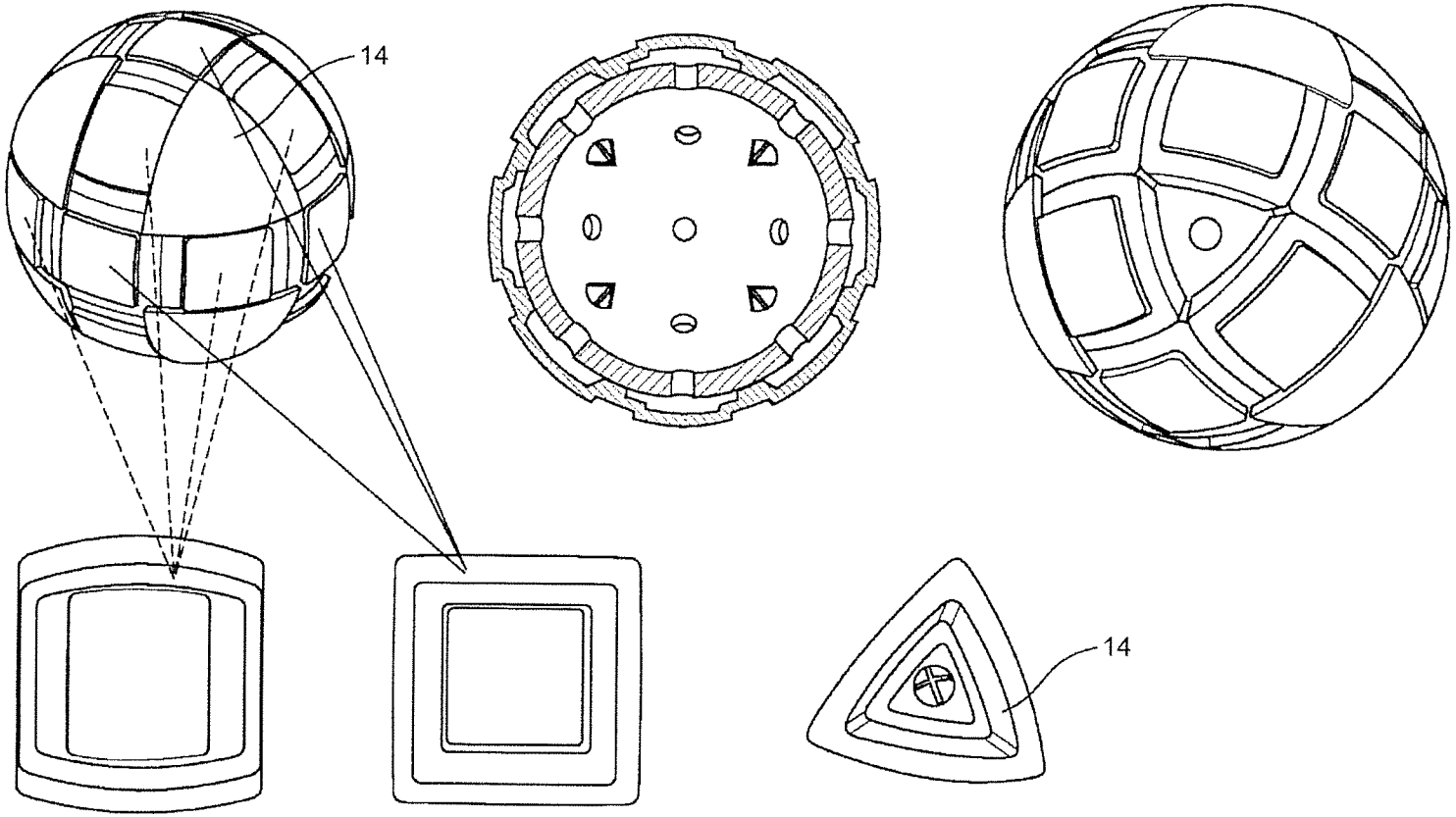
FIG. 4 shows a variation of the embodiments of FIGS. 1 to 3.

FIG. 4 shows another embodiment. A plurality of notionally triangular form pieces 14 are provided each having an anchoring mechanism to thereby define the first kind of pieces. Second and third kinds of pieces are provided having a notionally square shaped form, however, differ in that the second form of pieces have all parallel opposing sides and the third form pieces have at least two tapered opposing sides.

Each of the triangular form pieces has a retention mechanism in the form of a lip or overhang that extends from an upper portion of a side surface to at least partially enclose a top portion of second and third kinds of pieces. Preferably in this embodiment the second and third kinds of pieces are notionally square in form, however, differ in that the second kind of pieces have opposing sides that are somewhat tapered from a top surface to a bottom surface, relative to the surface of the centroid. Advantageously, predetermined selection of pieces having tapered sides allows for gap free layering of the surface of the centroid.

The fixed triangular pieces 14 form a series of channels or pathway or rotational bands that extend circumferentially about the centroid surface through which the second and third kinds of pieces are mobile. In this embodiment, three rotational bands are formed when the first second and third kinds of pieces are layered to the centroid surface.

The tapered opposing sides of the second kind of pieces allows mobility in a first direction where the tapered sides are tangentially aligned with the direction of extension of a channel, but not in a second direction where the tapered surfaces are in parallel alignment with the direction of extension of a channel. Preferably the second and third kinds of pieces are arranged such that they interchangeably repeat around the surface of the centroid. In this arrangement each of the pieces must be rotated 90 degrees about the surface of the centroid before the pieces of the third kind can be moved in a different direction through another channel.

According to each of the above described embodiments, each mobile piece, that is, the pieces of a second and third kind, are selectively moveable about the surface of the centroid, and through a channel, in a first direction before they are moveable through a channel that extends in another direction. In this way, each piece can be selectively navigated about the centroid surface by movement between any one of the available channels provided by the fixed pieces of a first kind. Further, entire circumferential or at least partially circumferential extending bands of moveable pieces can be simultaneously rotated relative to one or more fixed pieces. Further still, where a limited number of bands, such as one or two, are desired to be rotated about the surface of the centroid, the pieces that are not desired to be rotated, including any fixed pieces, can co-act or be moulded, joined or otherwise attached together, to the centroid, or a combination of both, to facilitate their fixation.

Figure 5:
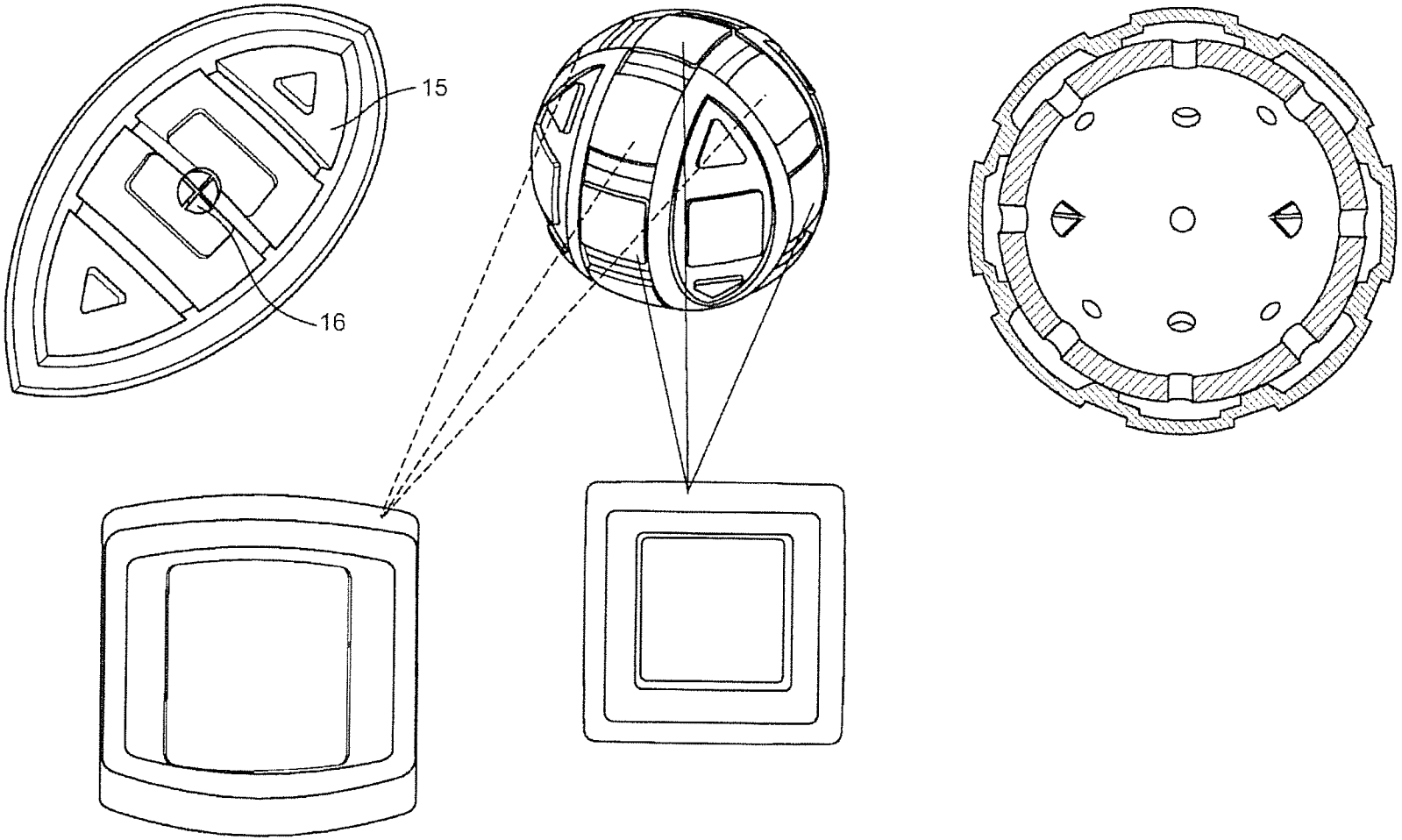
FIG. 5 shows a variation of the embodiments of FIGS. 1 to 4.

According to this advantageous solution of providing selective rotational bands, FIG. 5 shows a variation of the above embodiments having a piece 15 according to a first kind of pieces, that is an integrated combination of two notionally triangular form pieces and one notionally square form pieces. The piece 15 incorporates an anchoring mechanism 16, which may include one or more anchoring points. By selective placement of four pieces 16 about the surface of the centroid, two bands of rotational pieces, or planes, comprising the second and third kinds of pieces can be assembled. Each piece can be selectively transitioned between each band by rotation about the centroid surface approximately 180 degrees.

Preferably the pieces anchored to the centroid surface have a retention mechanism of the kind described above. Preferably pieces of the second kind of pieces have two opposing sides incorporating a tapered side profile that extends from an upper to a low surface.

Figure 6:
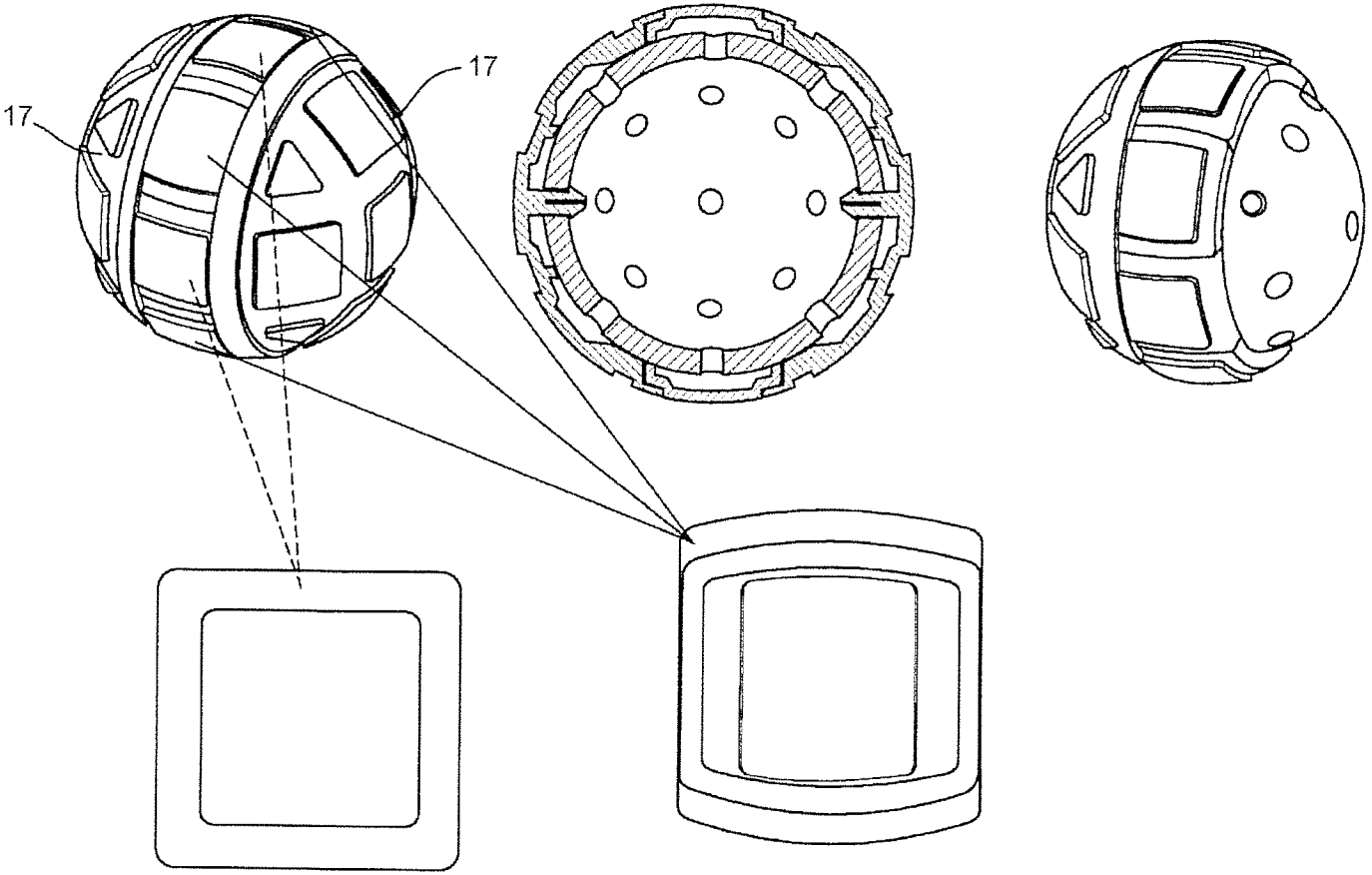
FIG. 6 shows a variation of the embodiments of FIGS. 1 to 5.

FIG. 6 shows a further variation of the above embodiments having a pair of pieces 17 that anchor to the centroid and substantially enclose the surface thus defining an end cap. A channel or pathways extending circumferentially is defined by a gap between the two pieces 17.

The channel or pathway is further defined by a retention mechanism, the retention mechanism in turn defined by a lip or overhang that extends at least partially outward from an upper portion of a side surface of each of the pieces.

Pieces according to a second and third kind of pieces, and preferably notionally square in form, are retained within the channel yet allowed to circumvent the surface of the centroid. At least one of the second or third form pieces has a pair of opposing sides incorporating a tapered side profile that extends from an upper to a low surface. Those opposing sides may also incorporate a bulbous profile when viewed outwardly from the notional centre of the centroid.

Figure 7:
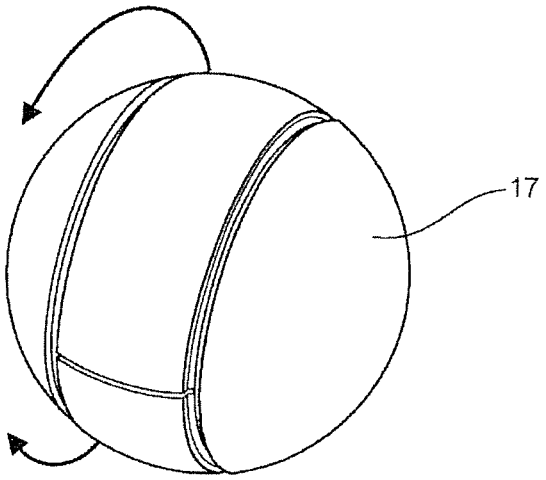
FIG. 7 shows an arrangement of pieces whereby an end cap is rotatable about the surface of a centroid about an axis of rotation.
Figure 8:
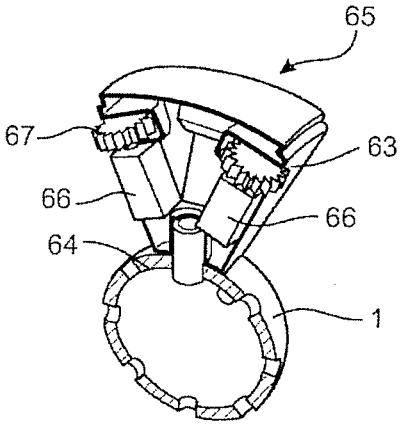
FIGS. 8 to 11 show a configuration of pieces adapted to attach to the centroid and provide motorised movement of other pieces.
Figure 9:
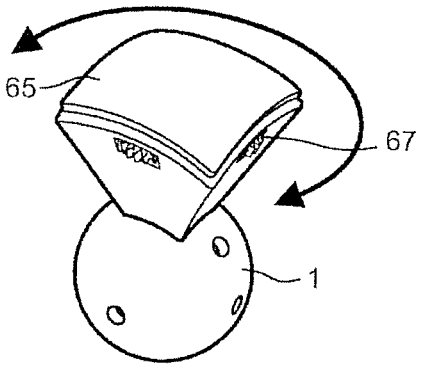
Figure 10:
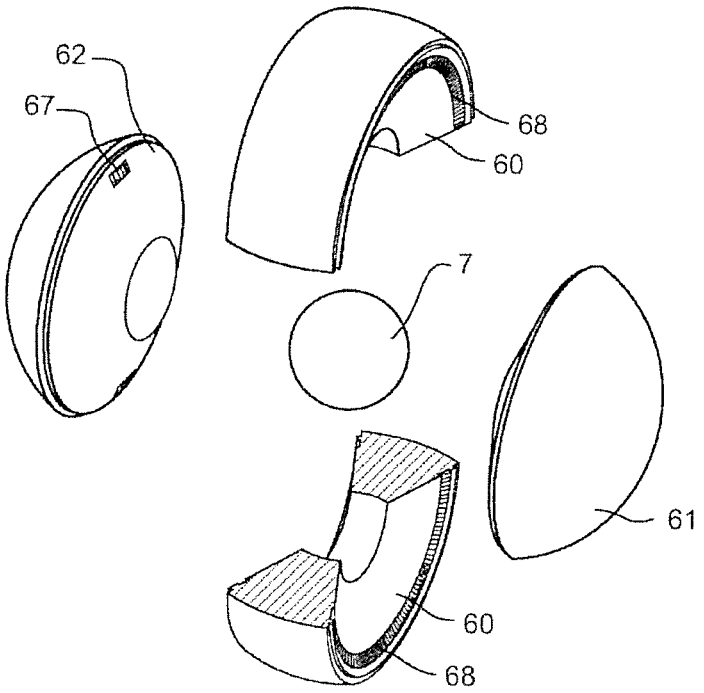
Figure 11:
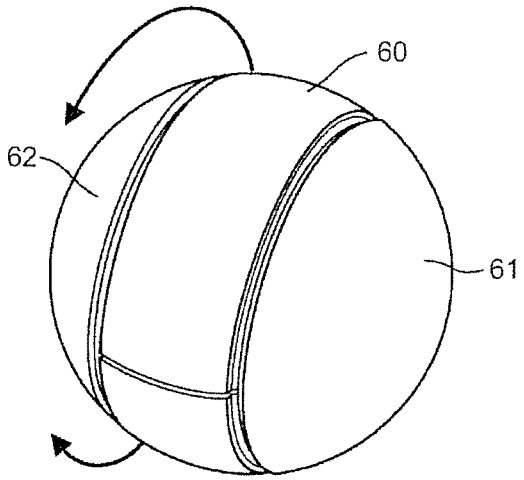

It should be noted that at least one of the pair of pieces 17 that anchor to the centroid and define end caps may instead be rotationally coupled to the centroid. In this way, the end cap may optionally rotate in addition to, or instead of any other rotatable bands of pieces or end caps. FIG. 7 shows an arrangement of pieces whereby a single end cap is rotatable about the surface of the centroid about an axis of rotation. The rotatable end cap may be fastened to the centroid surface by a rotatable anchoring mechanism that attaches at a single point, the point located at the centre of rotation of that piece.

For those pieces moveable about the centroid surface, movement is preferably facilitated by hand. That is, embodiments of the invention will provide amusement to a user by allowing them to selectively move pieces about the centroid surface to solve a puzzle or enact a game. However, rotation of pieces, groups of pieces or bands about the centroid may instead be facilitated by a motorised mechanism housed within one or more of those pieces.

For example, FIGS. 8 to 11 show a piece 65 adapted to attach to the centroid 1, where the anchoring mechanism is a peg like engagement 64. The piece 65 can be rotated to any orientation by virtue of the cylindrical peg shape. The piece 65 houses one or more motors 66 configured to rotate a drive gear 67. The gear 67 is coupled to a toothed track impression 68 on adjacent pieces. The gears 67 can be located on any side surface of any piece to thereby facilitate drive around any of the bands that are formed about the surface of the centroid 7. Rotation of the motor can facilitate rotation of a piece about its attachment to the centroid. Applications for such a mechanism include robotics, drill heads or any potentially other application requiring a rotational mechanism.

In an exemplary industrial application of the motorised pieces of FIGS. 8 to 11, rotation of one or more motorised end cap portions may facilitate drill like appendages or attachments. Other rotational bands of pieces may be used to facilitate swapping of drill appendages, for example, for a computer aided cutting machine.

Different configurations of pieces are shown. Each piece has an outer area which forms the exterior surface of the three-dimensional sphere. This area is connected to the centroid via a connector comprising a spacer 4 and a connector element.

Many different combinations of the elements that comprise each piece can be integrally moulded. For example, the area may be integrally moulded with a spacer. Alternatively, the piece may comprise a separate area which is then associated with an integrally moulded connector comprising the spacer and connector element.

In some embodiments said area may have indentations, projections, contours or surface configurations that project form the general surface of the sphere. In addition, due to the rounded shape of a sphere, the area of each piece may curve downwardly at its edges to help produce a more rounded sphere.

In one embodiment one or more (or all), of an edge or part thereof, of a piece is/are rounded. Preferably at least one corner of a playing piece is rounded. More preferably each corner of a substantially triangular piece (of the area's peripheral surface) is rounded. This helps facilitate smooth interaction between each adjacent piece.

A piece may comprise an area in the form of a tile. In one embodiment each tile is connected to a centroid via a connector, said connector comprising a spacer and a connector element. As stated above, many different combinations of each element could be integrally moulded.

With reference to Cartesian equatorial bands, there also exists rotating caps that are comprised of substantially square form and substantially triangular form playing pieces. As there are three Cartesian equatorial bands, it should be apparent that there are two sets of caps per Cartesian axis. i.e. six said caps per sphere.

The rotating caps may comprise of five substantially square form playing pieces and four substantially triangular form playing pieces. Said rotating caps rotate about the centroid in the same equatorial plane, but distal to, said single Cartesian equatorial reference band.

Preferably said cap is rotated two playing positions at a time. This ensures that said substantially triangular playing pieces fill a playing position filled previously by another triangular playing piece.

Preferably the length of indexing sides of each of the substantially square and triangular form pieces are substantially similar to that of the playing piece they index to. More preferably the chord lengths of each of the indexing sides of each piece are substantially similar. As used herein "chord length" is the length of the sides of the playing pieces when taken from corner to corner.

7. Magnetic Interaction

In some embodiments, the anchoring mechanism securing each piece is connected to the centroid using magnetic attraction. It should be appreciated that a number of different configurations providing for the magnetic interaction as an anchoring mechanism can be provided. For example, each of said pieces, or part thereof, may be formed from a magnetic element. e.g. rare earth magnet, with the centroid, or part thereof, being formed from a ferrous metal. Alternatively, the centroid, or part thereof, may comprise the magnetic element and therefore the connector or part thereof, comprise the ferrous element.

Preferably, where a magnetic type anchoring mechanism is used, the magnetic element used is a rare earth magnet. In such an instance the centroid may be, for example, a spherical magnet, a hollow spherical magnet or a lattice ball of magnets surrounding the periphery of the centroid. Other configurations may also be used that allow rotation of the pieces around the centroid.

When used as a magnetic latticed ball the centroid is arranged such that the lattice lines of the centroid magnets are oriented around the centroid so as to follow the lines of demarcation of the pieces. Alternately, the lattice lines of magnets surrounding the centroid may be oriented so that the playing pieces travel around the sphere over the said lattice lines. Further, pieces may comprise, wholly or in part, a moulded material having magnetic properties. Preferably when said piece(s) comprises a magnet, said magnet is located adjacent to the surface of said centroid.

It should also be appreciated that any magnetic element can extend any part thereof through the piece.

8. Indexing

In one embodiment the movement of said pieces between positions provides feedback to the user. Said feedback allows the user to determine when the pieces are indexed correctly into a playing position. Preferably said feedback during movement provides at least one or more of the following outcomes:

a sense of moving beyond an indexed position, and a sense of indexing to a correct position.

Said feedback mechanism can be a noise, a "feel" i.e. due to a physical mechanism, or a change in a physical feature of said sphere that can indicate to the user when the pieces are moved, or correctly indexed to a position.

In one embodiment said feedback mechanism is provided by a ratcheting mechanism which provides a sound and/or a feel when said pieces are moved due to the interaction with said ratcheting mechanism with a physical projection that interacts with said ratcheting mechanism.

In one embodiment said ratcheting mechanism is localised on the surface of a said piece. Preferably said ratcheting mechanism is localised on said substantially square form piece.

In one embodiment said physical projection is in the form of a projection that is on a piece that does not have localised thereto a ratcheting mechanism. Preferably said physical projection is able to interact with said ratcheting mechanism to provide feedback to the user as to when a piece is moved.

In one embodiment wherein said ratcheting mechanism is localised on said substantially square form piece, said physical projection is localised on said substantially triangular form playing piece. Preferably said physical projection is in the form of a ball bearing or the like.

In one embodiment said ball bearing is projected from a cavity in the side of said substantially triangular form playing piece so as to interact with said ratcheting mechanism.

In one embodiment said ball bearing is connected to a spring mechanism which causes said ball bearing to exert pressure on said ratcheting mechanism.

In one embodiment the feedback allowing the user to sense when the piece are correctly indexed is provided for by an indentation in the side of the piece which interacts with said piece containing the ball bearing. In this embodiment the interaction of the ball bearing with the ratcheting mechanism and indentation allow the user to determine when the pieces are being moved, and when they are in correct alignment respectively.

In one embodiment said feedback may be provided for by an interaction between said centroid and said pieces. Said feedback mechanism may be as described above or any other mechanism that allows the user to determine when the pieces are being moved, and when they are in correct alignment respectively.

9. Surface Shapes

In one embodiment said area is substantially flat. In alternate embodiments said area may have indentations, projections, contours, markings or the like. Said area may have surface alterations whilst still retaining the substantially square or triangular area form.

Alterations to the area detracting from a substantially flat surface may be in any form so long as they allow the pieces to be moved or indexed relative to each other without interference from adjacent pieces. Such surface alterations may be in many different forms including different shapes, colours etc.

In one embodiment said sphere 1 may be configured as a "lunar ball" wherein said surface alterations are to give a sense of a lunar landscape.

In a further embodiment said sphere 1 may be configured as a globe, wherein said surface alterations are to convey an earth-like sphere.

In a further embodiment said sphere 1 may be configured as a face wherein said playing pieces exhibit a facial feature, and wherein the migration of said playing pieces 2 can form different configurations of facial features.

In a further embodiment the overall shape of the puzzle may be of any other geometrical shape such as square or triangular. This can be achieved by the area of each playing piece being built up so that the overall shape of the puzzle becomes a desired geometrical shape. Thus rotation of the playing piece will result in uneven surface projections as a result of a non-spheroid outer geometrical shape rotating around a sphere form centroid (e.g. rotation of a square around the spheroid centroid).

The novel three-dimensional spherical puzzle or display platform is susceptible to variations and modifications which may be introduced thereto without departing from the inventive concept. For example, the number of playing pieces and the shape of the areas may be modified.

In addition, it should be appreciated that whilst a spherical surface area is the preferred embodiment of the current invention, the external area may form other shapes such as a square shape as seen with Rubik's cubes.

I claim:

1. A three-dimensional puzzle or display platform comprising a centroid and a tessellated surface of pieces about the centroid, each piece comprising a top and sides, and the pieces comprising a plurality of types of fixed pieces selected from
(i) square form pieces,
(ii) triangular form pieces,
(iii) integrated square form and triangular form pieces, and
(iv) one or more of (i) to (iii), and a plurality of moveable pieces selected from
(a) square form pieces,
(b) triangular form pieces,
(c) rectangular form pieces, and
(d) one or more of (a) to (c), and wherein the tessellated surface of pieces about the centroid is formed from a combination of fixed and moveable pieces with the proviso that if the fixed piece is a square form piece then the moveable pieces are selected from any one of (a) to (d), if the fixed piece is a triangular form piece then the moveable pieces are selected from (a) and/or (c), if the fixed piece is an integrated square form and triangular form piece then the moveable pieces are selected from (a) and/or (c), wherein the fixed pieces are fixed to the centroid by an anchoring mechanism that allows substitution of fixed pieces by each other, wherein the fixed pieces on the centroid are fixed relative to each other in a rotational plane about the centroid, wherein the centroid is a spherical centroid, and wherein the square form and triangular form pieces have sides of substantially equal chord length.

2. A puzzle or display platform of claim 1 wherein the triangular form piece is fixed, the fixed triangular pieces having sides defining a retention mechanism, the retention mechanism including at least a portion of each side surface extending over a portion the square form pieces, wherein a retention surface of the triangular pieces defines a three-dimensional platform, and wherein the anchoring mechanism allows substitution of the fixed pieces by other fixed pieces.

3. A puzzle or display platform of claim 1 wherein the square form piece is fixed, the fixed square form piece having sides defining a retention mechanism, the retention mechanism including at least a portion of each side surface extending over the other pieces, and, defining a plurality of channels that extends across the centroid surface through the surface area not occupied by those pieces that are anchored.

4. A puzzle or display platform of claim 1 wherein the moveable pieces have at least two opposing sides orientated obtusely relative to the top to define a moveable square retention surface, and the remaining surfaces oriented substantially perpendicular relative the top, the fixed pieces have at least two opposing sides orientated acutely relative to the top to define a fixed square retention surface, and the remaining surfaces oriented substantially perpendicular relative the top, and optionally the triangular pieces each have all sides orientated obtusely relative to the top.

5. A puzzle or display platform of claim 1, wherein a square form piece is fixed, wherein the fixed square form piece has at least two opposing sides orientated acutely relative to the top to define a fixed square retention surface, and the remaining surfaces oriented substantially perpendicular relative the top, the moveable square piece having at least two opposing sides orientated obtusely relative to the top to define a moveable square retention surface, and the remaining surfaces oriented substantially perpendicular relative the top, and the moveable triangular piece having all sides orientated obtusely relative to the top, wherein the fixed square retention surface indexes only with either the moveable square retention surface or the triangular piece surface to effect retention of the pieces to define the three-dimensional platform.

6. A puzzle or display platform of claim 1 wherein the anchoring mechanism allows rotation of each fixed piece about its axis.

7. A puzzle or display platform of claim 1 wherein the fixed pieces are readily substituted by one another.

8. A puzzle or display platform of claim 1 wherein the pieces are layered on the surface of the centroid such that the surface of the centroid is at least partially enclosed.

9. A puzzle or display platform of claim 1 wherein the moveable pieces define at least one pathway or channel.

10. A puzzle or display platform of claim 9 wherein at least one pathway extends around the surface of the centroid.

11. A puzzle or display platform of claim 9 wherein at least one pathway is defined by one or more rotational planes.

12. A puzzle or display platform of claim 9 wherein at least one pathway is defined by a plurality of rotation planes.

13. A puzzle or display platform of claim 9 wherein a plurality of rotational planes are evenly interspersed about the surface of the centroid.

14. A puzzle or display platform of claim 1 wherein the fixed pieces comprise a contour on at least one edge surface, the contour shaped, such that when abutted with the one or more of the moveable pieces, the moveable pieces are prevented from being lifted from the surface of the centroid.

15. A puzzle or display platform of claim 14 wherein the contour on at least one edge surface of the fixed pieces comprises a lip or overhang.

16. A puzzle or display platform of claim 15 wherein the lip or overhang extends, at least partially, above a portion of one or more of the moveable pieces.

17. A puzzle or display platform of claim 16 wherein the moveable pieces are retained by a lip or overhang and the surface of the centroid.

18. A puzzle or display platform of claim 14 wherein at least some of the moveable pieces, on at least one edge portion, define an edge profile such that when abutted with another of the moveable pieces, the moveable pieces are prevented from being lifted from the surface of the centroid.

19. A method of using a three-dimensional puzzle or display platform of claim 1 wherein a fixed piece is substituted by another fixed piece of a different type to define a three-dimensional puzzle or display platform having different channels of movement for the movable pieces.

* * * * *